United States Patent [19]

Uemura et al.

[11] Patent Number: 4,533,535

[45] Date of Patent: Aug. 6, 1985

[54] STARTING PITCHES FOR CARBON FIBERS

[75] Inventors: Seiichi Uemura, Tokyo; Shunichi Yamamoto; Takao Hirose, both of Kamakura; Hiroaki Takashima, Kawasaki; Osamu Katoh, Yokohama, all of Japan

[73] Assignee: Nippon Oil Co., Ltd., Tokyo, Japan

[21] Appl. No.: 579,206

[22] Filed: Feb. 10, 1984

[30] Foreign Application Priority Data

Feb. 14, 1983 [JP] Japan ..... 58-21622

[51] Int. Cl.[3] ..... D01F 9/12; C10C 3/02

[52] U.S. Cl. ..... 423/447.4; 423/447.6; 423/447.2; 208/22; 208/40; 208/23; 208/39

[58] Field of Search ..... 208/22, 23, 39, 44; 423/447.2, 447.4, 447.1, 447.6

[56] References Cited

U.S. PATENT DOCUMENTS 3,970,542 7/1976 Bongertman ..... 208/44
4,231,857 11/1980 Kato et al. ..... 208/22
4,271,006 6/1981 Dickakian ..... 208/44
4,397,830 8/1983 Uemura et al. ..... 208/22

FOREIGN PATENT DOCUMENTS 0063052 10/1982 European Pat. Off. ..... 208/22

*Primary Examiner*—D. E. Gantz
*Assistant Examiner*—Helane Myers
*Attorney, Agent, or Firm*—Bucknam and Archer

[57] ABSTRACT

A starting pitch for carbon fibers is obtained by mixing (1) 100 parts by volume of a heavy fraction oil boiling at not lower than 200° C. and obtained at the time of fluidized catalytic cracking of petroleum with (2) 10 to 200 parts by volume of a fraction boiling in the range of 250° to 550° C. obtained by distilling under reduced pressure an oil produced at the time of heat treating a starting pitch and then heat treating the resulting mixture at a temperature of from 370° C. to 480° C. under a pressure of from 2 to 50 $Kg/cm^2.G$ thereby to obtain the starting pitch for carbon fibers. The thus obtained starting pitch is heat treated to obtain a precursor pitch which is melt spun, infusibilized, carbonized or graphitized to obtain the carbon fibers.

1 Claim, 1 Drawing Figure

STARTING PITCHES FOR CARBON FIBERS

BACKGROUND OF THE INVENTION

1. Field of the Invention

This invention relates to pitches which are excellent as starting materials for the production of carbon fibers.

2. Description of the Prior Art

At present, carbon fibers are produced mainly from polyacrylonitrile as the starting material. However, polyacrylonitrile as the starting material for carbon fibers is disadvantageous in that it is expensive, tends not to retain its fibrous shape when heated for stabilization and carbonization and is carbonized in a low yield.

In view of the above, there have recently been reported a number of methods for producing carbon fibers from pitch. In cases where pitch is used as the starting material for producing carbon fibers, it is expected to obtain carbon fibers at a low cost since pitch is inexpensive and may be carbonized in a high carbonization yield of as high as 85–95%. However, carbon fibers obtained from pitch raise a problem that although they have higher tensile modulus, their tensile strength is poorer than those obtained from polyacrylonitrile. If, thus, there is found a method for solving the problem and further improving the pitch-derived carbon fibers in tensile modulus, such a method will render it possible to produce carbon fibers having high tensile strength and high tensile modulus at a low cost from pitch.

There was recently reported a method for producing carbon fibers having improved tensile modulus and tensile strength, which comprises heat treating a commercially available petroleum pitch to obtain a pitch containing optically anisotropic liquid crystals called "mesophase", providing the pitch containing the mesophase as a precursor pitch (such a pitch in the melt spinning step being hereinafter referred to as "precursor pitch"), melt spinning the precursor pitch, infusibilizing (making infusible) the melt spun pitch and then carbonizing or further graphitizing the pitch so infusibilized (Japanese Laid-open Patent Application No. 49-19127).

However, whether or not pitch may form liquid crystal therein depends on various factors. In addition, the resulting liquid crystals will greatly depend for their structure, softening point, viscosity and other physical properties on the type of starting pitch. The above-indicated Japanese Laid-open Patent Application deals with a method for producing a pitch containing the mesophase (hereinafter referred to as "mesophase pitch"), but it does not refer to anything about a starting pitch for producing a mesophase pitch of good quality therefrom. As mentioned before, it depends greatly on a starting pitch whether or not a mesophase pitch of good quality may be obtained therefrom. If a very desirable starting pitch is obtained, then it will be possible to produce therefrom carbon fibers having excellent tensile modulus and tensile strength. Therefore, it is an important problem in the field of this art how to find such a very desirable starting pitch.

For example, coal tar pitch contains carbon blacklike, quinoline-insoluble and infusible substances, and these undesirable substances cause the non-uniformity of the precursor pitch thereby not only degrading the spinnability but also having adverse effects on the tensile strength and tensile modulus of the resulting carbon fibers.

In contrast, many of commercially available petroleum pitches and synthetic pitches scarcely contain any quinoline-insoluble and infusible substances, however, they will produce quinoline-insoluble and high molecular weight substances when heat treated to prepare a precursor pitch therefrom. More particularly, when these pitches are heat treated, they will cause both thermal decomposition and polycondensation whereby the low molecular weight ingredients gradually convert to quinoline-insoluble high molecular weight ones. Further, the high molecular weight ingredients so formed will, in turn, form further high molecular weight ones, accompanied with a raise in softening point of the pitches. If these quinoline-insoluble ingredients are similar to the carbon black-like substances in coal tar, they will have adverse effects in the spinning and its subsequent steps as mentioned. In addition, even if the quinoline-insoluble ingredients are those which are different from the carbon black-like substances, the existence of the quinoline-insoluble substances in large amounts and the raise in softening point in the pitches will have adverse effects in the melt spinning step. More particularly, for melt spinning the precursor pitches, it is necessary to raise a spinning temperature to such an extent that the pitches have a viscosity sufficient to be melt spun. Thus, if the precursor pitches have too high a softening point, then the spinning temperature must naturally be raised with the result that the quinoline-insoluble ingredients form further high molecular weight ones, and the pitches cause their pyrolysis with light fraction gases being evolved thereby rendering it practically impossible to obtain homogeneous pitches and carry out melt spinning of the pitches.

As is seen from the above, it is essential that precursor pitches have a comparatively low softening point and a viscosity suitable to enable them to be spun. Furthermore, the precursor pitches must not be such that they contain a substantial amount of volatile ingredients at the time of spinning and carbonization.

For this reason, the quinoline-insoluble ingredients are removed by filtration under pressure, separation by solvent, or other suitable means to prepare precursor pitches for producing carbon fibers (Japanese Laid-Open Patent Application Nos. 47-9804, 50-142820, 55-1342 and 55-5954). However, the methods disclosed in these applications are not desirable from the economical point of view since they require complicated equipment and incur an increased cost.

It is the most preferable if there may be used, as the starting pitch, an excellent pitch which will not produce quinoline-insoluble high molecular weight ingredients when heated for for preparing the mesophase pitch.

The present inventors made intensive studies in an attempt to obtain such an excellent pitch. As a result, we obtained an excellent starting pitch which will inhibit the production of high molecular weight ingredients, have an optimum viscosity, and be able to have a composition allowing the aromatic planes to be easily arranged in order in the step of preparing precursor pitches.

SUMMARY OF THE INVENTION

It is accordingly an object of the invention to provide a starting pitch whose softening point is maintained at a relatively low level.

It is another object of the invention to provide a starting pitch for producing carbon fibers which readily forms a mesophase pitch.

It is a further object of the invention to provide a starting pitch for producing carbon fibers which inhibits formation of high molecular weight ingredients therefrom.

The above objects can be achieved, according to the invention, by a starting pitch for producing carbon fibers, obtained by mixing (1) 100 parts by volume of a heavy fraction oil boiling at not lower than 200° C. obtained at the time of fluidized catalytic cracking of petroleum with (2) 10 to 200 parts by volume of a fraction boiling in the range of from 250° to 550° C. obtained by distilling under reduced pressure an oil produced at the time of heat treating a starting pitch and then heat treating the resulting mixture at a temperature of from 370° C. to 480° C. under a pressure of from 2 to 50 Kg/cm$^2$.G, thereby to obtain the starting pitch for carbon fibers, the thus obtained starting pitch being heat treated to obtain a precursor pitch which is melt spun, infusibilized (made infusible), carbonized or graphitized to obtain the carbon fibers.

BRIEF DESCRIPTION OF THE DRAWING

A sole FIGURE is a flow chart showing a process of producing carbon fibers according to the present invention.

DETAILED DESCRIPTION OF THE INVENTION

Figure 1:
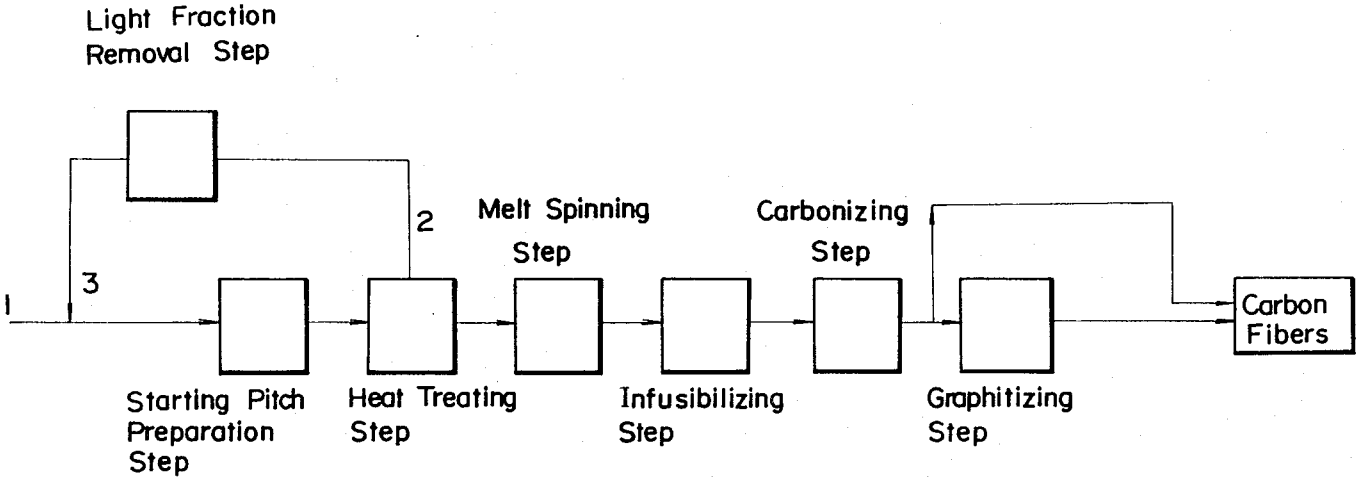

In case where the starting pitches of the present invention are subjected to production of mesophase pitches, it was unexpectedly found that the pitch yield was improved, the production of quinoline-insoluble ingredients was inhibited, the pitch was reformed, and the resulting final carbon fiber product had further high tensile modulus and high tensile strength.

In contrast, coal tar pitch, commercially available petroleum pitches and synthetic pitches were each heat treated according to the method as disclosed in Japanese Laid-open Patent Application No. 49-19127 in order to carry out mesophase formation thereon thereby obtaining heat treated pitches. For example, some of the thus heat treated had a softening point of 340° C. or higher, some thereof contained solid matter deposited therein and some thereof contained at least 70 wt % of quinoline-insoluble ingredients though they contained no solid matter deposited therein. It is practically impossible in many cases to melt spin these heat treated pitches. As to some of the heat treated pitches, which could be melt spun, they were then infusibilized, carbonized and graphitized to obtain carbon fibers. The thus obtained carbon fibers, however, had a tensile strength of as low as 120 to 200 kg/mm$^2$ and a tensile modulus of as low as about 12 to 20 tons/mm$^2$. Additionally, where pitches with high softening points were melt spun, there were present voids in the resulting spun product which were attributable to generation of gases resulting from the thermal cracking.

The heavy fraction oil which is used as an ingredient (1) of the starting pitch in the practice of the invention, has a boiling point not lower than 200° C. and is obtained at the time of fluidized catalytic cracking of petroleum, is a heavy fraction oil boiling substantially at 200° to 550° C., preferably 300° to 500° C. produced as a by-product at the time of fluidized catalytic cracking of kerosene, gas oil or topped crude at 450° to 550° C. under an atmospheric pressure to 20 kg/cm$^2$.G in the presence of a natural or synthetic silica-alumina catalyst or zeolite catalyst to produce light fraction oils such as gasoline.

The oil used as the ingredient (2) of the starting pitch of the invention is a fraction boiling substantially at 250° to 550° C., preferably 280° to 530° C. obtained by distilling under reduced pressure oils formed at the time of heat treating a starting pitch.

The starting pitch of the invention is obtained by mixing the heavy fraction oil (1) and the oil (2) in a specific mixing ratio, and then heat treating the oil mixture under specific conditions.

The mixing ratio of the heavy fraction oil (1) and the oil (2) should be in the range of 1:0.1–2, preferably 1:0.2–1.5 on the volume basis. The heat treating temperature is generally in the range of 370° to 480° C., preferably 390° to 460° C. The heat treatment at lower than 370° C. will allow the reaction to proceed slowly and take a long time to complete the reaction, this being economically disadvantageous. The heat treatment at higher than 480° C. will undesirably raise problems as to coking and the like. The heat treating time should be determined in view of the heat treating temperature; a long time is necessary for the low treating temperature, while a short time for the high treating temperature. The heat treating time may be in the range of usually 15 minutes to 20 hours, preferably 30 minutes to 10 hours. The heat treating pressure is not particularly limited but preferably such that the effective ingredients in the starting material are not substantially distilled off with being unreacted from the system. Thus, the pressure may actually be in the range of 2 to 50 Kg/cm$^2$.G, preferably 5 to 30 Kg/cm$^2$.G.

The starting pitches obtained by the heat treatment of the oil mixture may preferably be subjected to distillation or the like to remove the light fraction therefrom if necessary.

Reference is now made to the sole FIGURE, in which a heavy fraction oil which is the ingredient (1) for a starting pitch of the invention is charged from line 1 and an oil to be the ingredient (2) is charged from line 3 to mix the ingredients (1) and (2) in a predetermined ratio. Subsequently, the oil mixture is heat treated under certain conditions to prepare a starting pitch. The thus prepared starting pitch is heat treated under certain conditions. The resulting fraction boiling at a temperature ranging from 250° to 550° C. is withdrawn from line 2 and subjected to distillation under reduced pressure to remove light fraction oils therefrom, after which it is returned from line 3 as an ingredient of the starting pitch.

In carrying out the invention, no ingredient (2) of the starting pitch of the invention exists at an initial stage. In this case, other oils may be used instead of the ingredient (2) or the heavy fraction oil along may be subjected to the heat treatment, and a fraction boiling substantially at a temperature of 250° to 550° C. produced at the time of the heat treatment is subsequently used as the ingredient (2) for the starting pitch of the invention, thereby achieving the purposes of the invention.

In case where other oils are used instead of the ingredient (2) of the invention at the initial stage of the process, preferable oils used as a substitute for the ingredient (2) are, for example, fractions boiling from 250° to 550° C. obtained by steam cracking petroleum, fractions boiling from 250° to 550° C. obtained at the time of fluidized catalytic cracking of petroleum, and the like oil fractions.

The thus obtained pitches of the invention may be heat treated for mesophase formation to obtain precursor pitches having a composition allowing the aromatic planes to be easily arranged in order while preventing the production of high molecular weight ingredients which are insoluble in quinoline and preventing a raise in softening point of the pitch. As a result, carbon fibers which have very excellent tensile modulus and tensile strength may be obtained from the precursor pitches.

The starting pitches of the invention may be used in producing carbon fibers by the use of any known methods. More particularly, the starting pitch is heat treated for mesophase formation to obtain a precursor pitch, which is subsequently melt spun, followed by infusibilizing and carbonizing or further graphitizing to obtain carbon fibers.

The heat treatment of the starting pitch to obtain a precursor pitch may usually be carried out at 340° to 450° C., preferably 370° to 450° C. in the stream of an inert gas such as nitrogen under atmospheric or reduced pressure. The time for the heat treatment may be varied depending on the heat treating temperature, the flow rate of the inert gas, and the like, but it may usually be 1 to 50 hours, preferably 3 to 20 hours. The flow rate of the inert gas is preferably in the range of 0.7 to 5.0 scfh/lb pitch.

The method of melt spinning the precursor pitch may be a known method such as an extrusion, centrifugal or spraying method.

The pitch fibers obtained by melt spinning the starting pitch are then infusibilized in an oxidizing atmosphere. The oxidizing gases used for the purpose are oxygen, ozone, air, nitrogen oxides, halogens, sulfur dioxide and the like. These oxidizing gases may be used singly or in combination. The infusibilizing treatment is effected at such a temperature that the pitch fibers obtained by melt spinning are neither softened or deformed. Thus, the infusibilizing temperature may be, for example, 20° to 380° C., preferably 20° to 350° C. The time for the infusibilization may usually be in the range of 0.1 minute to 5 hours.

The thus infusibilized pitch fibers are subsequently carbonized or further graphitized in an inert gas atmosphere to obtain carbon fibers. The carbonization is usually carried out at a temperature of 800° to 2500p° C. for a time of 0.5 minutes to 10 hours. The further graphitization may be carried out at 2500° to 3500° C. for usually 1 second to 1 hour.

Further, the infusibilization, carbonization or graphitization may be effected with some suitable load or tension being applied to the mass to be applied in order to prevent the mass from shrinkage, deformation and the like, if necessary.

This invention is described more particularly by way of example which should not be construed as limiting the present invention.

EXAMPLE 1

A heavy fraction oil (A) having properties indicated in Table 1 was obtained by fluidized catalytic cracking of a desulfurized oil of an Arabian crude oil-derived vacuum gas oil (VGO) in the presence of a silica.alumina catalyst at 500° C.

This heavy fraction oil (A) was heat treated at a temperature of 430° C. under a pressure of 15 kg/cm$^2$.G for 3 hours. The thus heat-treated oil (B) was distilled at a temperature of 250° C./1 mmHg to distil off the light fraction therefrom to obtain a comparative starting pitch (1) having a softening point of 98° C. for use in the following Comparative Example.

Thirty parts by volume of a fraction (C) (whose properties are shown in Table 2) having a boiling point of from 200° to 350° C. and obtained by fluidized catalytic cracking of a desulfurized oil of an Arabian crude oil-derived vacuum gas oil (VGO) was mixed with 70 parts by volume of the heay fraction oil (A), followed by heat treating under a pressure of 15 kg/cm$^2$.G at a temperature of 430° C. for 3 hours. The resulting heat-treated oil was subjected to distillation to remove a light fraction therefrom under conditions of 250°C./1 mmHg to obtain a pitch (II) having a softening point of 65° C. Thirty grams of the pitch (II) was agitated while passing 700 ml/minute of nitrogen and heat treated at a temperature of 400° C. for 10 hours. Subsequently, the oil distilled in the heat treatment was distilled under conditions of 200° C./15 mmHg to collect a fraction (D) having a boiling point of 250° to 550° C. which may be used as a recycled oil (2) according to this invention. The properties of the fraction (D) are shown in Table 3.

TABLE 1

| Properties of Heavy Fraction Oil (A) | | |
|---|---|---|
| Specific Gravity (15° C./4° C.) | | 0.965 |
| Distillation | Initial boiling point | 320° C. |
| Properties | 5% | 340° C. |
| | 10% | 353° C. |
| | 30% | 385° C. |
| | 50% | 415° C. |
| | 70% | 445° C. |
| | 90% | 512° C. |

TABLE 2

| Properties of Fraction (C) | | |
|---|---|---|
| Specific gravity (15° C./4° C.) | | 0.871 |
| Refractive index $n_D^{25}$ | | 1.5081 |
| Average molecular weight | | 162 |
| Distillation | Initial boiling point | 210° C. |
| Properties | 10% | 232° C. |
| | 50% | 254° C. |
| | 90% | 305° C. |

TABLE 3

| Properties of Fraction (D) | | |
|---|---|---|
| Specific Gravity (15° C./4° C.) | | 1,085 |
| Average Molecular Weight | | 280 |
| Distillation | Initial boiling point | 255° C. |
| Properties | 10% | 315° C. |
| | 50% | 410° C. |
| | 90% | 504° C. |

Seventy parts by volume of the heavy fraction oil (A) was admixed with 30 parts by volume of the fraction (D), followed by heat treating under a pressure of 15 kg/cm$^2$.G at a temperature of 430° C. for 3 hours. The thus heat-treated oil was distilled under reduced pressure to remove the light fraction therefrom to obtain a starting pitch having a softening point of 70° C.

Thereafter, 30 g of the starting pitch was agitated while passing 600 ml/min. of nitrogen and heat treated at a temperature of 400° C. for 12 hours to obtain 26% of a pitch, based on the initial charge, having a softening point of 263° C., 8.7 wt % of quinoline-insoluble matters, and 85% of mesophase. This pitch was melt spun at 315° C. by the use of a spinner having nozzles with a diameter of 0.5 mm and 1/D=1 to obtain pitch fibers of 8–13 μ in diameter which were then infusibilized, carbonized and graphitized to obtain carbon fibers.

The infusibilization, carbonization and graphitization were carried out under the following conditions.

Infusibilizing conditions: raised at a rate of 10° C./min. in an atmosphere of oxygen and maintained at 330° C. for 1 minute.

Carbonizing conditions: raised at a rate of 10° C.min. in an atmosphere of nitrogen and maintained at 1000° C. for 30 minutes.

Graphitizing conditions: raised at a rate of 50° C./min. up to 2500° C. in the stream of argon.

The resulting carbon fibers had a tensile strength of 325° kg/mm$^2$ and a tensile modulus of 65 tons/mm$^2$.

COMPARATIVE EXAMPLE

The pitch (I) as obtained in Example 1 was used as a starting pitch and heat treated in the same manner as in Example 1 to obtain a pitch having a softening point of 300° C., 25.3 wt % of quinoline-insoluble matters and 95% of mesophase. This pitch was melt spun at 360° C. by the use of the spinner used in Example 1 to obtain pitch fibers of 16 to 20μ in diameter which were subsequently infusibilized, carbonized and graphitized in the same manner as in Example 1 to obtain carbon fibers.

The thus obtained fibers had a tensile strength of 168 kg/mm$^2$ and a tensile modulus of 28 tons/mm$^2$.

What is claimed is:

1. In the process of preparation of carbon fibers wherein a precursor pitch is melt spun, infusibilized, carbonized or graphitized, the improvement which comprises:

(a) in a first step, mixing 100 parts by volume of a heavy oil fraction (1) boiling at a temperature of 200°–550° C. obtained at the time of fluidized catalytic cracking of petroleum with 10–200 parts of volume of a recycled oil (2) boiling in the range of 250°–550° C., said recycled oil (2) being obtained by distilling under reduced pressure a fraction distilled in the following step (c) of producing said precursor pitch by heat treating said starting pitch obtained in step (b), (b) in a second step, heating said mixture of the fraction (1) and recycled oil (2) at a temperature of from 370° C. to 480° C. under a pressure of from 2 to 50 Kg/cm$^2$.G to obtain said starting pitch, (c) in a third step, heating the thus obtained starting pitch at a temperature of 340°–450° C. under atmospheric or reduced pressure to obtain said precursor pitch.

* * * * *